US012031202B2

(12) United States Patent
Shrinivas et al.

(10) Patent No.: US 12,031,202 B2
(45) Date of Patent: Jul. 9, 2024

(54) HIGH CARBON MARTENSITIC STAINLESS STEEL

(71) Applicant: STEER ENGINEERING PRIVATE LIMITED, Bengaluru (IN)

(72) Inventors: Vijay Shrinivas, Bengaluru (IN); Thillairajan Arumugam, Bengaluru (IN)

(73) Assignee: STEER ENGINEERING PRIVATE LIMITED, Bengalura (IN)

( * ) Notice: Subject to any disclaimer, the term of this patent is extended or adjusted under 35 U.S.C. 154(b) by 0 days.

(21) Appl. No.: 18/330,241

(22) Filed: Jun. 6, 2023

(65) Prior Publication Data

US 2023/0392240 A1 Dec. 7, 2023

(30) Foreign Application Priority Data

Jun. 7, 2022 (IN) ..... 202241032514

(51) Int. Cl.

| | |
|---|---|
| ***C22C 38/36*** | (2006.01) |
| ***C21D 1/18*** | (2006.01) |
| ***C21D 6/00*** | (2006.01) |
| ***C21D 7/13*** | (2006.01) |
| ***C21D 8/00*** | (2006.01) |
| ***C22C 33/04*** | (2006.01) |
| ***C22C 38/22*** | (2006.01) |
| ***C22C 38/24*** | (2006.01) |
| ***C22C 38/26*** | (2006.01) |

(52) U.S. Cl.

CPC ..... *C22C 38/36* (2013.01); *C21D 1/18* (2013.01); *C21D 6/002* (2013.01); *C21D 7/13* (2013.01); *C21D 8/005* (2013.01); *C22C 33/04* (2013.01); *C22C 38/22* (2013.01); *C22C 38/24* (2013.01); *C22C 38/26* (2013.01); *C21D 2211/008* (2013.01)

(58) Field of Classification Search

CPC ..... C22C 38/36; C22C 33/04; C22C 38/22; C22C 38/24; C22C 38/26; C21D 1/18; C21D 6/002; C21D 7/13; C21D 8/005; C21D 2211/008

See application file for complete search history.

(56) References Cited

U.S. PATENT DOCUMENTS

| | | | | |
|---|---|---|---|---|
| 5,674,449 | A * | 10/1997 | Liang | C22C 38/24 420/101 |
| 6,348,109 | B1 | 2/2002 | Sandberg | |
| 6,797,031 | B1 * | 9/2004 | Engstrom | C21D 8/065 75/239 |
| 7,563,333 | B2 | 7/2009 | Sandberg et al. | |
| 10,329,647 | B2 | 6/2019 | Cheney et al. | |

FOREIGN PATENT DOCUMENTS

| | | | | |
|---|---|---|---|---|
| CN | 100415924 | | 9/2008 | |
| DE | 19924515 | | 11/2000 | |
| DE | 19924515 | A1 * | 11/2000 | B22F 3/115 |

OTHER PUBLICATIONS

Hryha et al., "Microstructure Development in Powder Metallurgy Steels: Effect of Alloying Elements and Process Variables," Materials Science Forum, published online Apr. 9, 2014, pp. 467-472, vol. 782, Switzerland.

* cited by examiner

*Primary Examiner* — Jenny R Wu
(74) *Attorney, Agent, or Firm* — Workman Nydegger

(57) ABSTRACT

A high carbon martensitic stainless steel is disclosed. Said high carbon martensitic stainless steel comprises 1.7 to 1.9% by weight C, 17 to 18% by weight Cr, 1.6 to 2.0% by weight Mo, 2.9 to 3.5% by weight V, 0.40 to 0.60% by weight Nb, and Fe as main constituent. Further, the high carbon martensitic stainless steel has a microstructure comprising of primary carbides in an amount of 15 to 30% by volume and secondary carbides in an amount less than 2% by volume.

11 Claims, 9 Drawing Sheets

HIGH CARBON MARTENSITIC STAINLESS STEEL

CROSS-REFERENCE TO RELATED APPLICATIONS

The present application claims the benefit of and priority to Indian Patent Application No. 202241032514, filed Jun. 7, 2022, the entire content of which is incorporated herein by reference.

FIELD OF INVENTION

The present disclosure relates to a high carbon martensitic stainless steel having improved forgeability, impact strength, wear, and corrosion resistance.

BACKGROUND

Martensitic stainless steels typically have carbon content between 0.1 wt % and 1.2 wt %. Generally, high carbon martensitic stainless steels having up to 1.2 wt % of carbon are manufactured using the conventional ingot casting method, and those having >1.2 wt % of carbon, are manufactured using the technique of powder metallurgy.

If higher strengths are desired, the carbon content of the steel can be increased as carbon is the principal element responsible for hardness in steel and a variety of other properties such as strength and toughness (impact strength). However, known martensitic stainless steels having carbon>1.3% suffer from one or more of poor corrosion resistance, wear resistance, and forgeability, or are expensive to manufacture.

SUMMARY

A high carbon martensitic stainless steel is disclosed. Said high carbon martensitic stainless steel comprises 1.7 to 1.9% by weight C, 17 to 18% by weight Cr, 1.6 to 2.0% by weight Mo, 2.9 to 3.5% by weight V, 0.40 to 0.60% by weight Nb, and Fe as main constituent. Further, the high carbon martensitic stainless steel has a microstructure comprising of primary carbides in an amount of 15 to 30% by volume and secondary carbides in an amount less than 2% by volume.

DETAILED DESCRIPTION

Figure 1A:
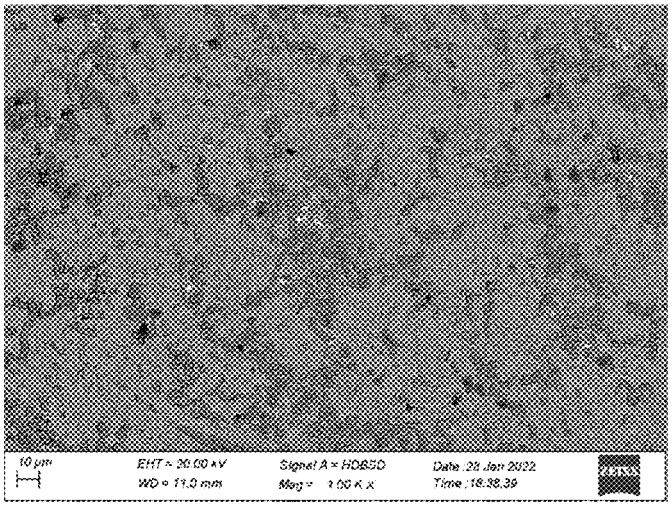
FIGS. 1A and 1B show 1× and 3× magnified images, respectively, of microstructure of high carbon martensitic stainless steel, prepared in accordance with an embodiment of the present disclosure.

For the purpose of promoting an understanding of the principles of the disclosure, reference will now be made to embodiments and specific language will be used to describe the same. It will nevertheless be understood that no limitation of the scope of the disclosure is thereby intended, such alterations and further modifications in the disclosed composition and method, and such further applications of the principles of the disclosure therein being contemplated as would normally occur to one skilled in the art to which the disclosure relates.

It will be understood by those skilled in the art that the foregoing general description and the following detailed description are exemplary and explanatory of the disclosure and are not intended to be restrictive thereof.

Reference throughout this specification to "one embodiment" "an embodiment" or similar language means that a particular feature, structure, or characteristic described in connection with the embodiment is included in at least one embodiment of the present disclosure. Thus, appearances of the phrase "in one embodiment", "in an embodiment" and similar language throughout this specification may, but do not necessarily, all refer to the same embodiment.

The terms "comprise", "comprising", or any other variations thereof, are intended to cover a non-exclusive inclusion and are not intended to be construed as "consists of only", such that a process or method that comprises a list of steps does not include only those steps but may include other steps not expressly listed or inherent to such process or method.

Likewise, the terms "having" and "including", and their grammatical variants are intended to be non-limiting, such that recitations of said items in a list are not to the exclusion of other items that can be substituted or added to the listed items.

Unless defined otherwise, all technical and scientific terms used herein have the same meaning as commonly understood by one of ordinary skill in the art to which this disclosure belongs. Although any methods and materials similar or equivalent to those described herein can be used in the practice or testing of the disclosure, the preferred methods, and materials are now described. All publications mentioned herein are incorporated herein by reference.

The term "primary carbides" primarily refers to $M_7C_3$ carbides formed from the liquid metal by Carbon (C) and Metals (M) such as Iron (Fe), Chromium (Cr), Vanadium (V), Niobium (Nb), Molybdenum (Mo) in the martensitic matrix of steel, and comprises Cr in a mole fraction of 40 to 70%, and other elements such as V, Mo, Fe in the mole fraction of 0.5 to 20% in the martensitic matrix of steel.

The term "secondary carbides" primarily refers to $M_{23}C_6$ carbides precipitated from austenite by C and M such as Fe, Cr, V, Nb, Mo in the martensitic matrix of steel, and comprises Cr in the mole fraction of 50 to 90%, and other elements such as V, Mo, Fe in the mole fraction of 0.5 to 20% in the martensitic matrix of steel.

The term "Specific Metal Carbides" primarily refers to carbides formed from the liquid metal by C and M such as Fe, Cr, V, Nb, Mo in the martensitic matrix of steel, and comprises either Nb in the mole fraction of 40 to 70% (referred to as "Niobium rich carbides") or V in the mole fraction of 40 to 90% (referred to as "Vanadium rich carbides"), and traces of other metals such as Cr, Fe in the mole fraction of up to 10%, in the martensitic matrix of steel.

In its broadest scope, the present disclosure relates to a high carbon martensitic stainless steel. Said high carbon martensitic stainless steel comprises 1.7 to 1.9% by weight C, 17 to 18% by weight Cr, 1.6 to 2.0% by weight Mo, 2.9 to 3.5% by weight V, 0.40 to 0.60% by weight Nb, and Fe as main constituent, wherein the high carbon martensitic stainless steel has a microstructure comprising of primary carbides in an amount of 15 to 30% by volume and secondary carbides in an amount less than 2% by volume.

In an embodiment, the microstructure of the high carbon martensitic stainless steel is predominantly martensitic.

Figure 1B:
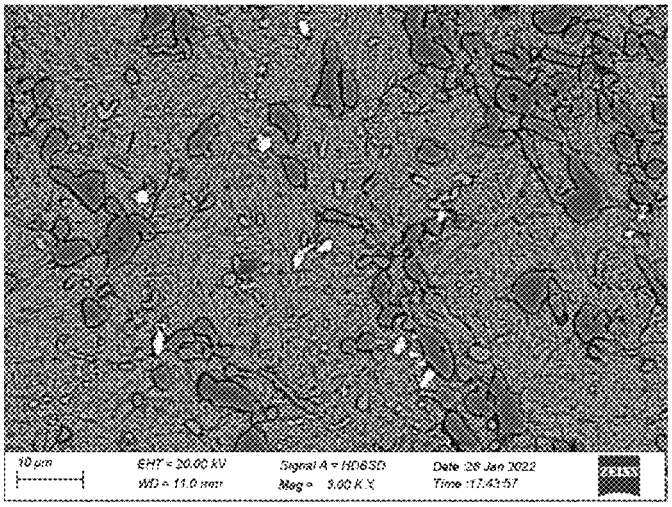

The high carbon martensitic stainless steel of present disclosure comprises primary carbides which are of uniform size and are uniformly distributed in the microstructure of steel. FIGS. 1A and 1B show the distribution of primary carbides in the microstructure of high carbon martensitic stainless steel, prepared in accordance with an embodiment of the present disclosure.

In an embodiment, the microstructure comprises primary carbides having a mean carbide diameter (Equivalent Circle Diameter) in the range of 10 to 30 microns, with the distance between consecutive (or nearest) primary carbides ranging from 0.4 to 0.6 microns. In some embodiments, the microstructure comprises primary carbides having the mean carbide diameter of about 17.19 microns, with the distance between consecutive primary carbides of 0.51 microns. In an embodiment, the carbides in the disclosed high carbon martensitic stainless steel have a mean aspect ratio ranging from 1 to 2. In some embodiments, the carbides have a mean aspect ratio of 1.9.

In an embodiment, the microstructure of the high carbon martensitic stainless steel comprises primary carbides in the range of 20 to 30% by volume. In an embodiment, the microstructure of the high carbon martensitic stainless steel comprises secondary carbides in an amount less than 1% by volume. In an embodiment, the microstructure of the high carbon martensitic stainless steel comprises specific metal carbides in the range of 1 to 5% by volume. In some embodiments, the microstructure of the steel comprises specific metal carbides in the range of 2 to 4% by volume. The specific metal carbides improve the wear resistance of the disclosed high carbon martensitic stainless steel.

The present inventors found that both the disclosed composition and microstructure are critical to achieving the high carbon martensitic stainless steel having improved impact strength, wear, and corrosion resistance, and forgeability.

In an embodiment, the disclosed high carbon martensitic stainless steel has a hardness ranging from 53 to 57 HRC. In some embodiments, the high carbon martensitic stainless steel has the hardness of 55 to 57 HRC. In some embodiments, the high carbon martensitic stainless steel has the hardness of 55 HRC.

In an embodiment, the high carbon martensitic stainless steel has a Charpy impact strength ranging from 18 to 24 $J/mm^2$. In some embodiments, the high carbon martensitic stainless steel has the Charpy impact strength of 20 to 21 $J/mm^2$. In some embodiments, the high carbon martensitic stainless steel has the Charpy impact strength of 20 $J/mm^2$.

In an embodiment, the high carbon martensitic stainless steel shows corrosion resistance for a time ranging from 200 to 300 hours before failing in a tensile loading condition of 350 MPa in a $H_2S$ atmosphere as per NACE 0177-201. In some embodiments, the high carbon martensitic stainless steel shows corrosion resistance for 220 to 280 hours before failing in a tensile loading condition at 350 MPa in the $H_2S$ atmosphere as per NACE 0177-201. In some embodiments, the high carbon martensitic stainless steel shows corrosion resistance for 220 hours before failing in a tensile loading condition at 350 MPa in the $H_2S$ atmosphere as per NACE 0177-201.

In an embodiment, the high carbon martensitic stainless steel has a wear mass loss ranging from 200 to 280 $mm^3$ when measured for 30 minutes under 45 N load with alumina abrasives. In some embodiments, the high carbon martensitic stainless steel has the wear mass loss of 260 to 280 $mm^3$ when measured for 30 minutes under 45 N load with alumina abrasives. In some embodiments, the high carbon martensitic stainless steel has the wear mass loss of 260 $mm^3$ when measured for 30 minutes under 45 N load with alumina abrasives.

In an embodiment, the high carbon martensitic stainless steel comprises C in the amount ranging from 1.80 to 1.90% by weight. In some embodiments, the high carbon martensitic stainless steel comprises C in the amount of 1.8% by weight.

In an embodiment, the high carbon martensitic stainless steel comprises Cr in the amount ranging from 17.0 to 17.5% by weight. In some embodiments, the high carbon martensitic stainless steel comprises Cr in the amount of 17% by weight.

In an embodiment, the high carbon martensitic stainless steel comprises Mo in the amount ranging from 1.90 to 2.0% by weight. In some embodiments, the high carbon martensitic stainless steel comprises Mo in the amount of 2% by weight. Alloying of Nb and Mo at the disclosed percentage reduces the formation of primary carbides by half and contributes to enhancing the forgeability of the disclosed high carbon martensitic stainless steel.

In an embodiment, the high carbon martensitic stainless steel comprises V in the amount ranging from 3.1 to 3.20% by weight. In some embodiments, the high carbon martensitic stainless steel comprises V in the amount of 3.2% by weight.

In an embodiment, the high carbon martensitic stainless steel comprises Nb in the amount ranging from 0.45 to 0.50% by weight. In some embodiments, the high carbon martensitic stainless steel comprises Nb in the amount of 0.5% by weight.

The high carbon martensitic stainless steel comprises Nickel (Ni) in trace amounts. In an embodiment, the high carbon martensitic stainless steel comprises Ni in an amount up to 0.50% by weight. In some embodiments, the high carbon martensitic stainless steel comprises Ni in the amount of 0.20% by weight.

In an embodiment, the high carbon martensitic stainless steel comprises Silicon (Si) in an amount ranging from 0.30 to 0.60% by weight. In some embodiments, the high carbon martensitic stainless steel comprises Si in the amount of 0.36% by weight.

The high carbon martensitic stainless steel comprises Tungsten (W) in trace amounts. In an embodiment, the high carbon martensitic stainless steel comprises W in an amount up to 0.07% by weight. In some embodiments, the high carbon martensitic stainless steel comprises W in the amount of 0.01% by weight.

In an embodiment, the high carbon martensitic stainless steel comprises Manganese (Mn) in an amount ranging from 0.40% to 0.60% by weight. In some embodiments, the high carbon martensitic stainless steel comprises Mn in the amount of 0.45% by weight.

The present disclosure also relates to a process for preparing the disclosed high carbon martensitic stainless steel. In an embodiment, the process for preparing said high carbon martensitic stainless steel comprises: providing a steel composition comprising 1.7 to 1.9% by weight C, 17 to 18% by weight Cr, 1.6 to 2.0% by weight Mo, 2.9 to 3.5% by weight V, 0.40 to 0.60% by weight Nb, and Fe as main constituent; melting the steel composition; transferring the molten steel composition to a die casting mold; demolding the steel composition at a temperature in a range of 850 to 950° C. followed by forced air cooling; preparing the steel composition for open die forging; subjecting the steel composition to open die forging, subjecting the steel composition to anti-flaking heat treatment, followed by hardening and tempering to obtain high carbon martensitic stainless steel.

Melting of the steel composition is carried out using any known apparatus. In an embodiment, the melting is carried out in an induction furnace at a temperature ranging between 1470 and 1520° C., for a time ranging from 60 to 90 minutes.

After melting, the molten composition is transferred into a die casting mold using any known method. In an embodiment, the transfer is carried out using pouring ladle at a uniform pour rate.

In an embodiment, in the die casting mold, the steel composition is allowed to cool to a temperature in the range of 850 to 950° C. for up to 5 minutes. The demolding is carried out at a temperature in the range of 850 to 950° C. The steel composition obtained after demolding is subjected to forced air cooling using any known means, such as cooling in direct forced air or indirect forced air. The present inventors found that demolding at the temperature in the range of 850 to 950° C., followed by forced air cooling prevents the formation of secondary carbides.

After forced air cooling, the material is prepared for open die forging using known means. In an embodiment, the material is prepared by heating the material at a temperature in a range of 1100 to 1200° C. for a time of 30 to 50 minutes/inch soak with the minimum forging temperature of 950° C. In some embodiments, the material is prepared by heating the material at a temperature of 1120 to 1150° C. for a time of 30 to 50 minutes/inch soak with the minimum forging temperature of 950° C.

In the next step, the anti-flaking treatment is carried out to diffuse hydrogen out of the steel. The anti-flaking treatment is carried out using known means by heating the steel composition below the lower critical temperature (AC1) followed by adequate soaking to allow hydrogen to diffuse out of the steel. In an embodiment, the anti-flaking heat treatment is carried out at a temperature between 760 and 800° C., for a time ranging from 15 to 25 hours. In some embodiments, the anti-flaking heat treatment is carried out at a temperature of 760 to 780° C., for a time ranging from 18 to 20 hours.

In an embodiment, the hardening is carried out using known means at a temperature ranging between 1080 and 1130° C., for a time of 30 to 60 minutes/inch soak. In some embodiments, the hardening is carried out at the temperature ranging between 1110 and 1130° C. for a time of 30 to 60 minutes/inch soak. In an embodiment, after hardening, the steel composition is quenched in oil. Any oil known for quenching of steel can be used.

In an embodiment, the quenched steel composition is subjected to tempering using known means at a temperature between 320 and 370° C., for a time of 60 to 90 minutes/inch. In some embodiments, the quenched steel composition is subjected to tempering at the temperature of 350 to 370° C., for the time of 60 to 90 minutes/inch. This tempered steel composition is then formed into a finished product.

EXAMPLES

In order that this invention may be better understood, the following examples are set forth. These examples are for the purpose of illustration only and the exact compositions, methods of preparation and embodiments shown are not limiting of the invention, and any obvious modifications will be apparent to one skilled in the art.

Also described herein are method for characterizing the high carbon martensitic stainless steel formed using embodiments of the claimed process.

Example 1: Comparison of Exemplary High Carbon Martensitic Stainless Steel with Conventional High Carbon Steel Having Similar Composition The high carbon martensitic stainless steel (INV1) prepared in accordance with an embodiment of the present disclosure was compared with high carbon martensitic stainless steel (CR4) prepared using a conventional ingot casting method.

The INV1 and CR4 had a composition including Fe and other untested, metals as well as the following elements in the amounts stated below:

TABLE 1

Composition of INV1 and CR4

| Element | INV1 | CR4 |
|---|---|---|
| C (%) | 1.8 | 1.7 |
| Cr (%) | 17 | 17 |
| Mo (%) | 2 | 1 |
| V (%) | 3.2 | 3.2 |
| Nb (%) | 0.5 | — |

Process used to prepare INV1: A steel composition was prepared as per the composition stated in Table 1 above. The steel composition was subjected to melting at 1520° C. After melting, the molten steel composition was transferred to a die casting mold at the temperature of 1470° C. followed by demolding. The demolding of the steel composition was carried out at the temperature of 950° C. followed by forced air cooling using direct forced air. The demolded steel composition was prepared for open die forging at the temperature of 1150° C. for a time of 50 minutes/inch soak with the minimum forging temperature of 950° C. In the next step, the steel composition was subjected to open die forging. This forged steel composition was subjected to anti-flaking heat treatment at the temperature of 760 to 780° C., for a time ranging from 18 to 20 hours. The obtained steel composition was subjected to hardening at the temperature of 1120° C. for a time of 60 minutes/inch soak. After hardening, the steel composition was quenched in oil. The quenched steel was subjected to tempering at the temperature of 370° C. for a time of 90 minutes/inch to obtain the high carbon martensitic stainless steel. This tempered steel composition is then formed into a finished product.

Process used to prepare CR4: Conventional ingot casting method was used to prepare CR4.

Assessment of Primary, Secondary and Specific Metal Carbides in CR4 and INV1: CR4 and INV1 were assessed to compute the percentage of primary, secondary, and specific metal carbides therein.

Characterization Method: Multiple microstructural images were recorded at various magnifications with Dewinter Microscope and processed through image processing software (Biowizard software) to estimate the total % of carbides (Primary, Secondary and specific Metal carbides). EDAX (Energy Dispersive X-Ray) mapping was carried out using JEOL Scanning Electron Microscope to evaluate the chemical composition of each carbide. Based on the chemical composition of each carbide, primary, secondary and specific metal carbides were identified.

Figure 2A:
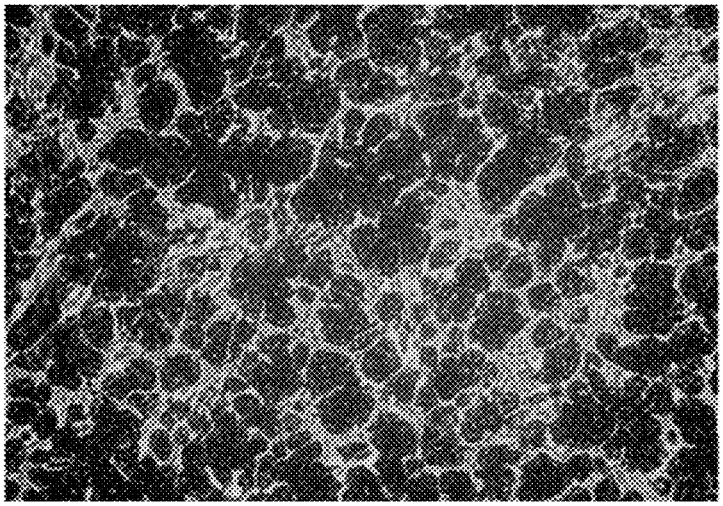
FIGS. 2A and 2B show the microstructure of a conventional high carbon martensitic stainless steel and a high carbon martensitic stainless steel prepared in accordance with an embodiment of the present disclosure, respectively.
Figure 2B:
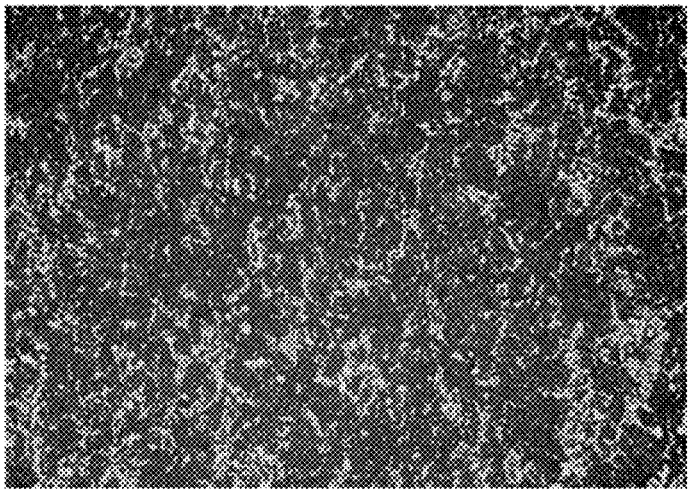
Figure 3A:
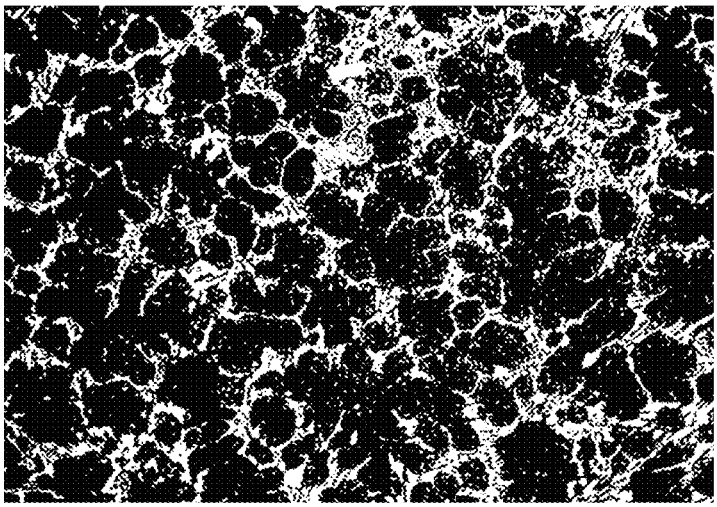
FIGS. 3A and 3B show the black phase (stainless steel matrix) and white phase (carbides) in the microstructure of the conventional high carbon martensitic stainless steel and the high carbon martensitic stainless steel prepared in accordance with an embodiment of the present disclosure, respectively.
Figure 3B:
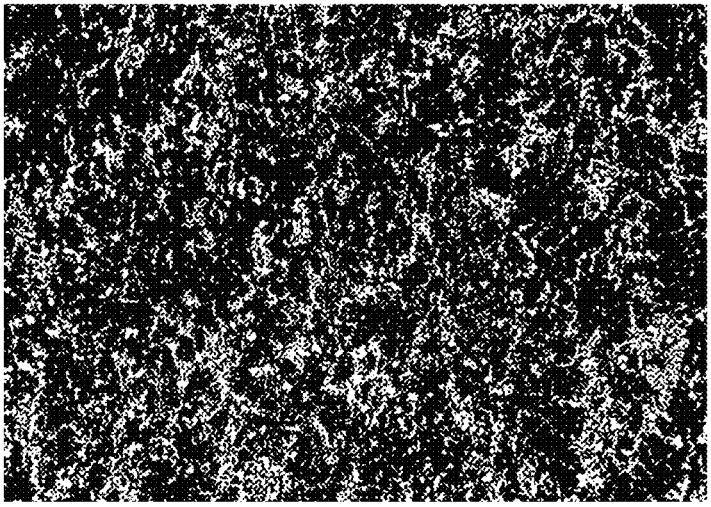
Figure 4A:
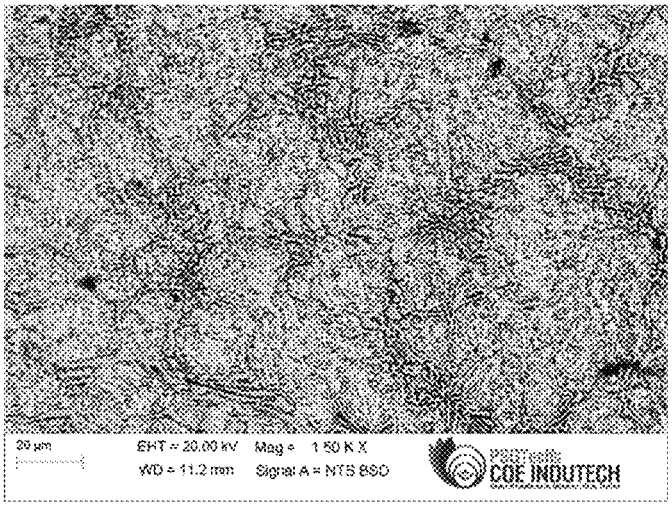
FIGS. 4A and 4B indicate the primary and secondary carbides in the SEM-EDAX microstructure of the conventional high carbon martensitic stainless steel and the high carbon martensitic stainless steel prepared in accordance with an embodiment of the present disclosure, respectively.
Figure 4B:
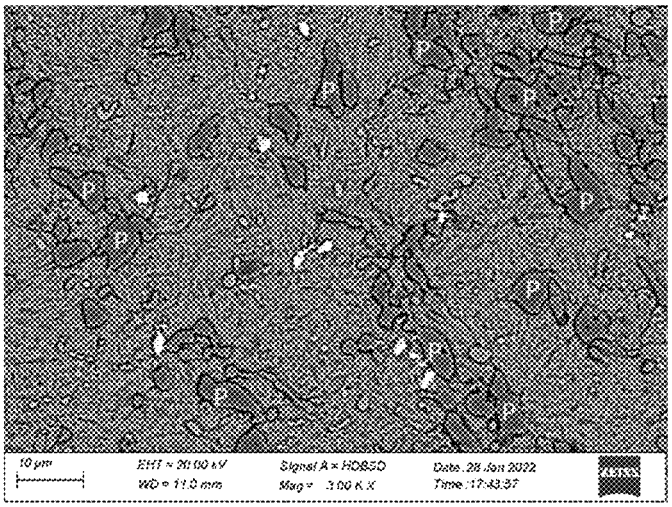

FIGS. 2A and 2B show the microstructure of CR4 and INV1, respectively. FIGS. 3A and 3B show the black phase (stainless steel matrix) and white phase (carbides) in the microstructure of CR4 and INV1, respectively. FIGS. 4A and 4B indicate the primary and secondary carbides in the SEM-EDAX microstructure of CR4 and INV1, respectively.

The percentages of the primary, secondary, and specific metal carbides in the microstructure of both CR4 and INV1 have been tabulated in Table 2 below:

TABLE 2

Percentage of Carbides

| Nature of Carbides | INV1 | CR4 |
|---|---|---|
| Total % carbides | 22-25% | 28-32% |
| Total % primary carbides | 18-20% | 15-19% |
| Total % secondary carbides | 1-2% | 13-15% |
| Specific metal carbides (Niobium rich carbides and Vanadium rich carbides) | 2-4% | <1% |

Figure 5A:
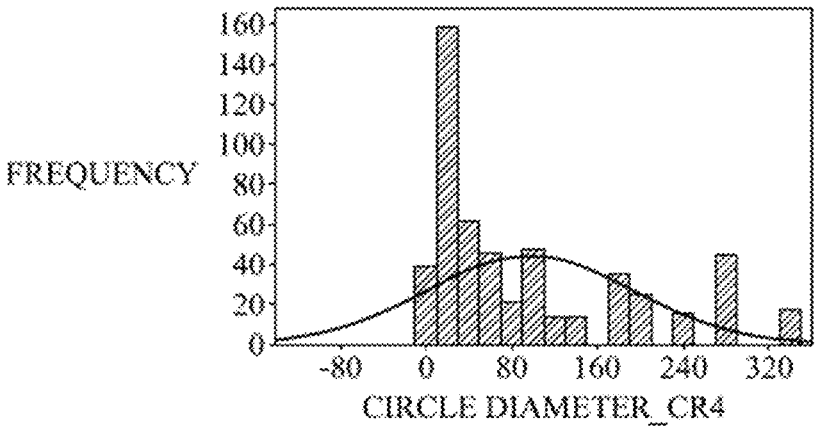
FIGS. 5A and 5B show a comparison of mean carbide diameter (Equivalent Circle Diameter) in the conventional high carbon martensitic stainless steel and the high carbon martensitic stainless steel prepared in accordance with an embodiment of the present disclosure, respectively.
Figure 5B:
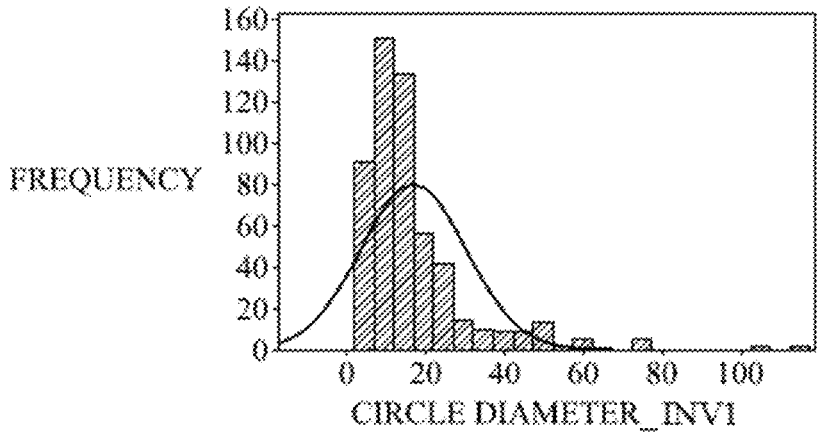
Figure 6A:
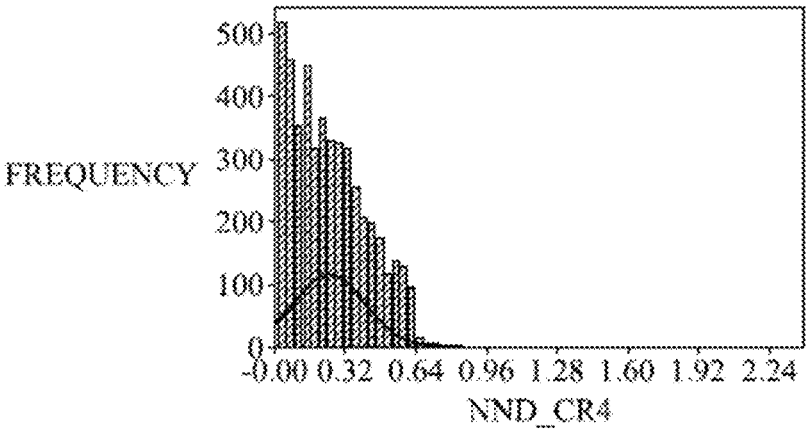
FIGS. 6A and 6B show a comparison of the nearest neighbor distance of carbides in the conventional high carbon martensitic stainless steel and the high carbon martensitic stainless steel prepared in accordance with an embodiment of the present disclosure, respectively.
Figure 6B:
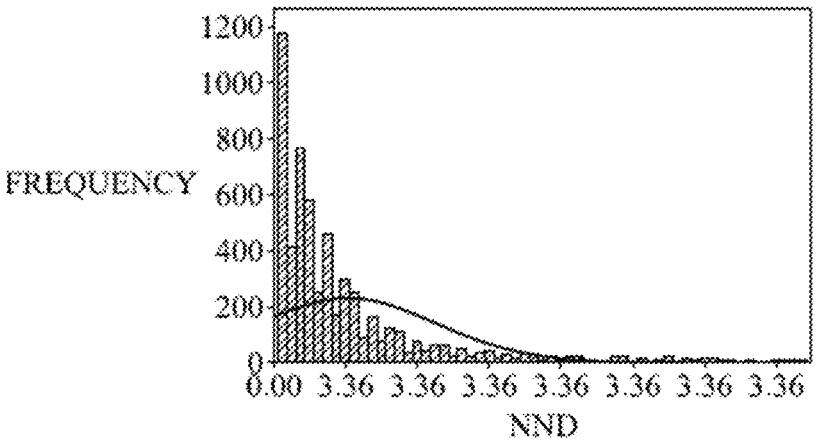
Figure 7A:
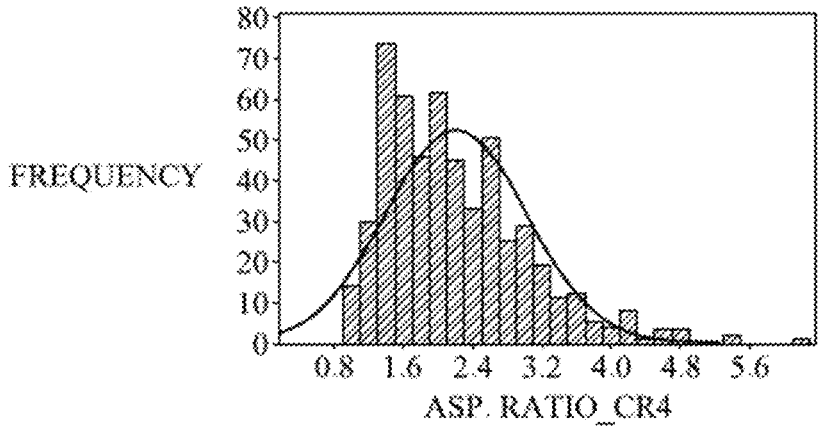
FIGS. 7A and 7B show a comparison of the aspect ratio of carbides in the high carbon martensitic stainless steel and the high carbon martensitic stainless steel prepared in accordance with an embodiment of the present disclosure, respectively.
Figure 7B:
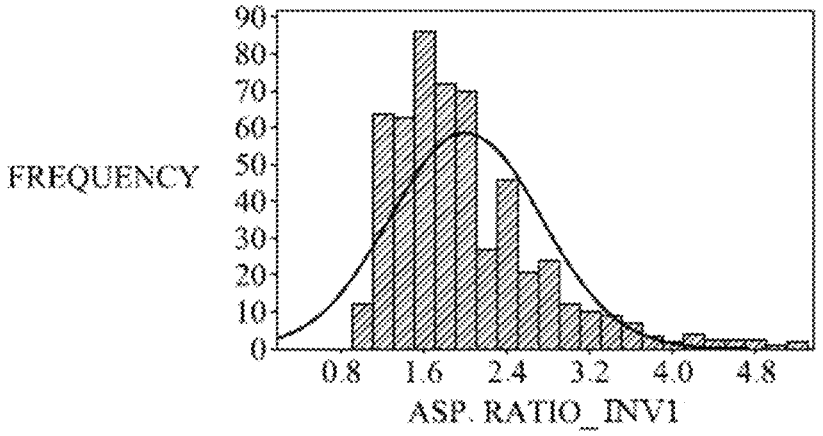

FIGS. 5, 6 and 7 show a comparison of the equivalent circle diameter, nearest neighbor distance and aspect ratio, respectively, of primary carbides in microstructure of CR4 and INV1. The characteristics of primary carbides in microstructure of both CR4 and INV1 have been tabulated in Table 3 below:

TABLE 3

Characteristics of Primary Carbides in Microstructure of INV1 and CR4

| Parameter | INV1 | CR4 |
|---|---|---|
| Mean Equivalent Circle Diameter (microns) | 17.19 (St. Dev = 13.52, N = 541) | 96.49 (St. Dev = 97.68, N = 540) |
| Mean Nearest Neighbor Distance (microns) | 0.48 (St. Dev = 0.6077, N = 5804) | 0.25 (St. Dev = 0.1624, N = 4690) |
| Mean Aspect Ratio | 1.9 (St. Dev = 0.7351, N = 541) | 2.2 (St. Dev = 0.8196, N = 539) |

Both INV1 and CR4 were tested for assessing their impact strength, wear resistance and corrosion resistance.

Characterization Methods Used:

1. Impact Strength: Charpy impact test, or Charpy V-notch test (IS code 1757) was conducted under following conditions to assess the impact strength of steel:
   Notch: Nil;
   Temperature: 24° C.
2. Wear resistance: Rubber wheel abrasion test (ASTM G65) was conducted under load of 45 N, for 30 minutes to assess the wear resistance of the steel.
3. Stress Corrosion test: The susceptibility to stress corrosion was measured as per NACE 0177-2016, under the following atmosphere:
   $H_2S$ @ 200 ml/min/lit;
   5% Nacl+0.5% glacial acetic acid;
   pH: 2.7;
   Load: 25-45% of UTS;
   Temperature: 24° C.

Figure 8:
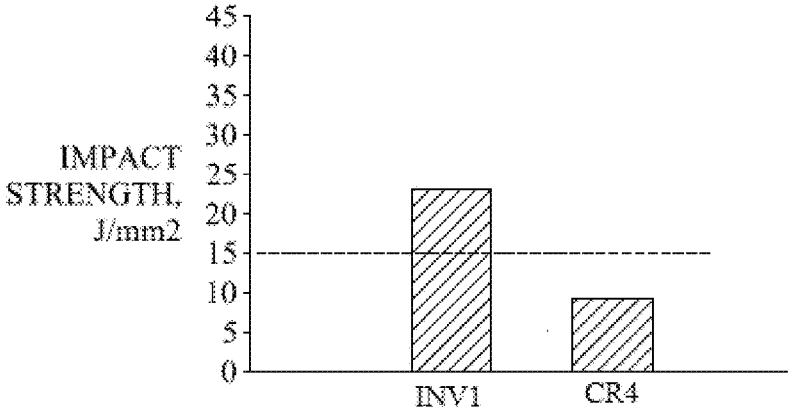
FIG. 8 shows a comparison of the impact strength of conventional high carbon martensitic stainless steel and the high carbon martensitic stainless steel prepared in accordance with an embodiment of the present disclosure.
Figure 9:
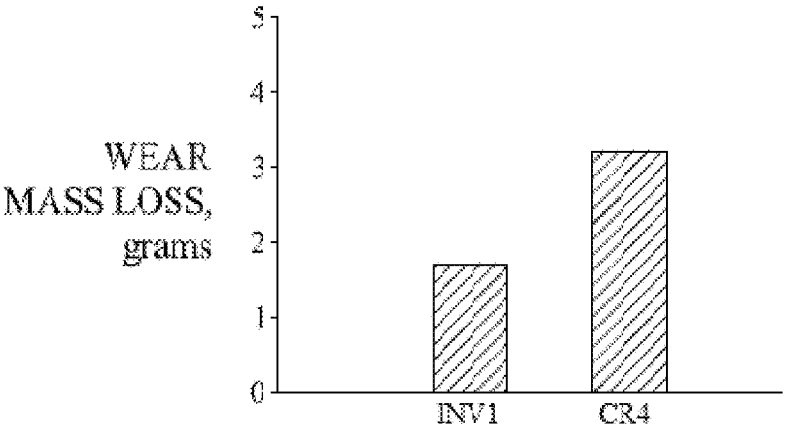
FIG. 9 shows a comparison of the wear resistance of conventional high carbon martensitic stainless steel and the high carbon martensitic stainless steel prepared in accordance with an embodiment of the present disclosure.
Figure 10:
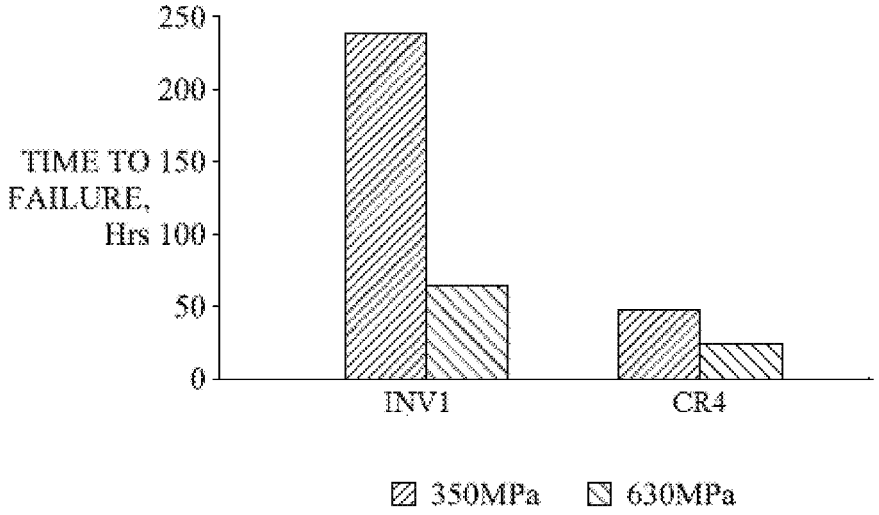
FIG. 10 shows a comparison of the stress corrosion resistance of conventional high carbon martensitic stainless steel and the high carbon martensitic stainless steel prepared in accordance with an embodiment of the present disclosure.

Results and Observation: FIG. 8 shows a comparison of the impact strength of CR4 and INV1. It was observed that INV1 exhibits about 155% improvement in impact strength as compared to CR4. FIG. 9 shows a comparison of the wear resistance of CR4 and INV1. It was observed that INV1 exhibits about 47% improvement in wear resistance as compared to CR4. FIG. 10 shows a comparison of the corrosion resistance of CR4 and INV1. It was observed that INV1 exhibits about 400% improvement in stress corrosion resistance as compared to CR4.

INDUSTRIAL APPLICABILITY

The disclosed high carbon martensitic stainless steel, while being cost-effective, exhibits significantly improved forgeability and properties such as impact strength, wear resistance, and corrosion resistance as compared to high carbon martensitic stainless steel manufactured through the conventional ingot casting method followed by forging or rolling operation.

The disclosed high carbon martensitic stainless steel can be manufactured using existing apparatus and system.

We claim:

1. A high carbon martensitic stainless steel comprising:
1.7 to 1.9% by weight C,
17 to 18% by weight Cr,
1.6 to 2.0% by weight Mo,
2.9 to 3.5% by weight V,
0.40 to 0.60% by weight Nb,
up to 0.07% by weight of W, and
Fe as a main constituent, wherein the high carbon martensitic stainless steel has a microstructure comprising primary carbides in an amount of 15 to 30% by volume and secondary carbides in an amount less than 2% by volume.

2. The high carbon martensitic stainless steel as claimed in claim 1, wherein the microstructure of the high carbon martensitic stainless steel comprises specific metal carbides in an amount of 1 to 5% by volume.

3. The high carbon martensitic stainless steel as claimed in claim 1, comprising 1.8 to 1.9% by weight C.

4. The high carbon martensitic stainless steel as claimed in claim 1, comprising 3.1 to 3.2% by weight V, 1.8 to 2% by weight Mo, 17 to 17.5% by weight Cr, and 0.4 to 0.5% by weight Nb.

5. The high carbon martensitic stainless steel as claimed in claim 1, wherein the primary carbides have a mean carbide diameter in the range of 10 to 30 microns.

6. The high carbon martensitic stainless steel as claimed in claim 1, wherein the distance between consecutive primary carbides is in the range from 0.4 to 0.6 microns.

7. The high carbon martensitic stainless steel as claimed in claim 1, wherein the primary carbides have a mean aspect ratio in the range of 1 to 2.

8. The high carbon martensitic stainless steel as claimed in claim 1, having a hardness ranging from 53 to 57_HRC.

9. The high carbon martensitic stainless steel as claimed in claim 1, having a Charpy impact strength ranging from 18 to 24 J/mm2.

10. The high carbon martensitic stainless steel as claimed in claim 1, having a corrosion resistance for a time ranging from 200 to 300 hours before failing in a tensile loading condition of 350 MPa in a H2S atmosphere as per NACE 0177-201.

11. The high carbon martensitic stainless steel as claimed in claim 1, having a wear mass loss ranging from 200 to 280 mm3 when measured for 30 minutes under 45 N load with alumina abrasives.

* * * * *